US005711481A

United States Patent [19]

MacDonald et al.

[11] Patent Number: 5,711,481

[45] Date of Patent: Jan. 27, 1998

[54] PROCESS AND APPARATUS FOR CREATING FOG FOR SPECIAL EFFECTS

[75] Inventors: Robert A. MacDonald, Camarillo; Aidan Bradley, Thousand Oaks, both of Calif.

[73] Assignee: Spectra F/X, Inc., Calif.

[21] Appl. No.: 578,199

[22] Filed: Dec. 29, 1995

[51] Int. Cl.[6] ..... A01G 15/00; E01H 13/00; F02M 25/10

[52] U.S. Cl. ..... 239/2.1; 239/14.1; 239/DIG. 7; 62/52.1; 261/16; 261/DIG. 76

[58] Field of Search ..... 252/305; 239/2.1, 239/8, 14.1, 419.5, 398, 428.5, 429, DIG. 7; 62/52.1, 121; 261/16, DIG. 76

[56] References Cited

U.S. PATENT DOCUMENTS

| | | | |
|---|---|---|---|
| 1,665,267 | 4/1928 | Jernberg | 239/2.1 X |
| 3,141,615 | 7/1964 | Waldron, Jr. | 239/8 |
| 3,367,581 | 2/1968 | Kizilos et al. | 239/DIG. 7 X |
| 3,788,825 | 1/1974 | Arenson | 62/52.1 |
| 4,336,017 | 6/1982 | Desty | 239/DIG. 7 X |
| 5,156,333 | 10/1992 | Worsfold | 239/2.1 |

*Primary Examiner*—Andres Kashnikow
*Assistant Examiner*—Robin O. Evans
*Attorney, Agent, or Firm*—Oppenheimer Poms Smith

[57] ABSTRACT

The present invention's fog generating apparatus has a mixing chamber. A steam nozzle in the mixing chamber injects high pressure steam into the chamber. The injected steam entrains ambient air, pulling it through an air opening into the mixing chamber. The steam and air mix to form humid air. Cryogenic fluid, preferably liquid nitrogen, is injected through a nozzle, which is positioned in the path of the humid air. The cryogenic fluid rapidly cools the warm, humid air which generates large quantities of fog. Depending of the way the steam is injected and the design of the mixing chamber, the present invention can generate slow or fast moving fog.

7 Claims, 3 Drawing Sheets

PROCESS AND APPARATUS FOR CREATING FOG FOR SPECIAL EFFECTS

BACKGROUND OF THE INVENTION

1. Field of the Invention

The present invention relates to a process and apparatus create special effects fog using steam and liquid nitrogen.

2. State of the Art

Fog creates may interesting special effects. For example, a low or ground-hugging fog blanket may signal a scary night. Low fog also has been an effect for bands and singers. For many years, one generated low fog by dropping pieces of dry ice, which is solid, very cold $CO_2$, in heated or boiling water. $CO_2$ becomes solid at −78° C. (−108° F.). As the solid $CO_2$ warms and changes phase to a cold gas, it causes the vapor above the heated or boiling water to cool. The water vapor in the $CO_2$/vapor mixture becomes saturated and turns to fog.

Creating large quantities of fog quickly and stopping fog generation quickly using this method is difficult. Because the solid dry ice is in a water bath, stopping fog generation requires removal of all pieces of dry ice from the water. Even if one can remove all dry ice from the water, the removal process takes time. Therefore, fog generation not stop immediately.

Further, because the fog is a mixture of $CO_2$ and water vapor, the fog tends to displace ambient air. $CO_2$ also is denser than air so fog containing a high percentage of $CO_2$ tends to sink toward the floor or ground. Thus, if the fog extends above the heads of actors and stage hands, they may not receive enough oxygen to breath properly. If the fog effect is combined with an effect that uses fire, the decreased oxygen level within the fog may inhibit combustion.

Because of the problems with dry ice-created fog, newer systems use liquid nitrogen ($LN_2$) instead of dry ice. The boiling point of $LN_2$ is −196° C. (−321° F.). One system sprays $LN_2$ above heated or boiling water. The cryogenic $LN_2$ cools the water vapor and causes the water vapor to become saturated. This creates fog.

The $LN_2$ system is much easier than the dry ice system to control. The $LN_2$ flow can be and stopped quickly. However, the amount of water vapor that the heated water creates is limited and variable. Therefore, it is difficult to create large volumes of fog using this method. Fog quality also varies considerably depending on the ambient temperature and relative humidity. Also, the fog contains a mixture of $N_2$ and water vapor with little oxygen. Accordingly, less oxygen is available for breathing or combustion.

SUMMARY OF INVENTION

The principal object of the present invention is to disclose and provide a process and apparatus that generates large quantities of fog quickly and can start and stop fog generation quickly. Another object of the present invention is to disclose and provide such a process and apparatus in which the fog contains enough oxygen for normal and for sustaining combustion. Another object of the present invention is to disclose and provide such a process and apparatus in which the quality of the fog is more controllable. That is, it is less dependent on ambient temperature and relative humidity.

Another object of the present invention is to disclose and provide such a process an apparatus that can create large volumes of either slow or fast moving fog. Large volumes of slow moving fog can create a fog curtain, similar to a conventional stage curtain in that it blocks the view behind the stage. Unlike conventional curtains, actors, props or effects can pierce a fog curtain anywhere, not just where conventional curtains come together. Thus, with a fog curtain, an actor on a mechanical arm can move through the curtain at any height and any location. The actor also can move along the audience side of the curtain while the fog hides the mechanical arm. This can create dramatic effects.

The present method and apparatus meets these and other objects. The present process for creating special effects fog first injects steam toward an open end a chamber. The cooling and expanding steam entrains ambient air and pulls the air into the chamber. The steam and air mix to become a stream of fast moving, humid air. The humid air stream flows toward the open end of the chamber. Next, cryogenic fluid is injected into the steam and air. This application uses the term "cryogenic fluid" instead of "cryogenic liquid." In use, a cryogenic liquid may be close to boiling point as it warms during storage. In the present invention, cryogenic liquid may or completely vaporize to cryogenic gas as it is injected into the steam/air mixture. The term cryogenic fluid refers to very cold liquid or gas near or below the liquid's boiling point. The cryogenic fluid rapidly cools the steam/air mixture causing it to become supersaturated as fog. Because of the large amount of air in the mixture, the fog has sufficient oxygen to sustain breathing and support combustion.

The process can use the coanda effect in which a laminar flow of gas tends to curved along a curved surface. Steam from a boiler or other steam generator is directed through a slot along a first curved surface. As the steam expands and cools, it tends to entrain a large volume of atmospheric air. The air/steam mixture becomes a fast moving stream of warm, very humid air. Downstream, a second coanda device, which is in the path of the warm, humid air, directs cryogenic fluid, preferably $LN_2$, along its curved The evaporating, but still very frigid gas or liquid rapidly cools the humid air. The rapid cooling and turbulence as the two streams meet mix rapidly cools the humid air. The mixture becomes a single, fast moving stream of water fog that includes air, water vapor and the evaporated cryogenic liquid.

Mixing also can take place within a chamber or in a nozzle. If a nozzle is used, jets direct downstream into the nozzle. The nozzle has an upstream opening that is exposed ambient air. Cooling and expanding injected steam entrains ambient air and pulls the air into the nozzle. The steam and air mix to become a stream of fast moving, humid air. Cryogenic fluid is sprayed into the nozzle in the humid air path. The cryogenic fluid mixes with the humid air to create fog, which injects itself from the nozzle.

For slower moving and large volumes of fog, one can inject both steam and $LN_2$ into a cl amber. The chamber is open to allow the cooling and expanding steam to entrain ambient air. The steam and air mix with the $LN_2$ within the chamber and create large volume of fog. A tube then leads from the chamber to allow the fog to be directed to the proper location.

These and other objects of the invention may be seen more clearly from the detailed description of the preferred embodiment that follows.

DETAILED DESCRIPTION OF THE PREFERRED EMBODIMENTS

Figure 1:
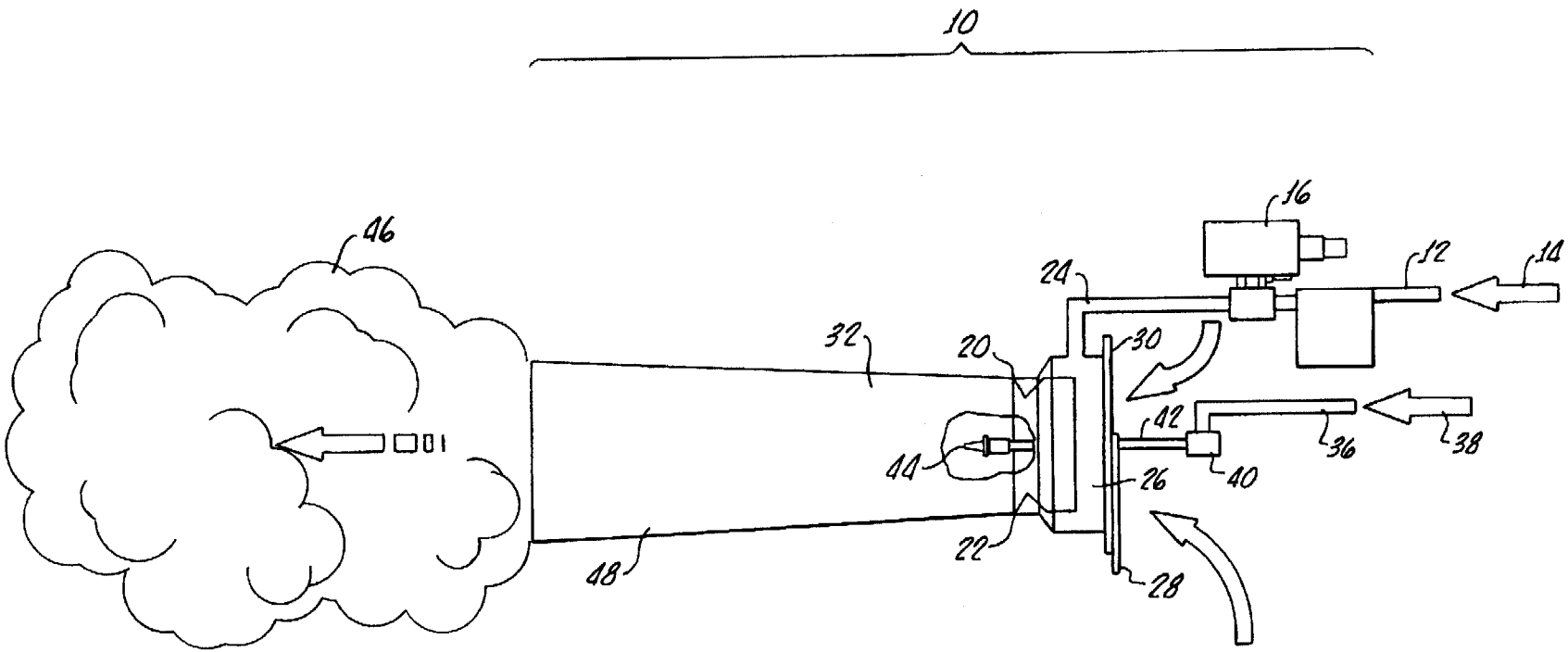
FIG. 1 is a schematic drawing of one exemplary embodiment of the apparatus for creating fog for special effects of the present invention. This embodiment is designed to create high volume and high velocity fog.

FIG. 1 shows a first exemplary embodiment of the apparatus 10 that creates special effects fog of the present invention. High pressure steam flows into the device from a steam inlet. In the exemplary embodiment, a steam generator such as a boiler (not shown) generates high pressure steam. Steam tubing 12 connects to the boiler and carries high pressure steam (arrow 14 shows the steam flow). The steam encounters a steam separator 16 to remove liquid $H_2O$ from the steam line. A control valve may selectively block or limit steam flowing through steam tubing 12. At a minimum, valve 16 has on/off capabilities so that fog generation can stop and start quickly. The valve also may control the amount of steam flowing downstream to control the extent of fog generation.

From the valve, the high pressure steam flows into circumferential nozzles. FIG. 1 shows two such nozzles 20 and 22 branching from steam pipe 24. Though FIG. 1 shows only two nozzles, the device can use one, three or more nozzles. The nozzles mount at the upstream end of entrainment region or chamber 26. The chamber is open upstream of the nozzles. The open end allows ambient air to flow into the entrainment region 26. Vanes in the form of pivoting doors 28 and 30 can control the amount of air that can enter the entrainment region.

As nozzles 20 and 22 inject high pressure steam, the steam expands and cools. This steam entrains air and draws it into the entrainment region 26 where the air and steam mix to form a stream of fast moving, highly humid air. The humid air stream mixture flows at high velocity into mixing region 32.

The invention then injects cryogenic fluid from a cryogenic fluid inlet into the humid air. Liquid nitrogen, $LN_2$, is the preferred cryogenic fluid, but the invention also can use liquid oxygen or other cryogenic liquids. $LN_2$ is available, inert and inexpensive relative to other cryogenic liquids. $LN_2$ flows into the device from an $LN_2$ dewar or storage tank (not shown). Although one could generate cryogenic liquid on site, most users of cryogenic liquid have the liquid delivered in tanker trucks. Tubing 36 for $LN_2$ connects to the tank and carries $LN_2$ (see arrow 38). $LN_2$ tubing 36 connects to control valve 40 to block or limit $LN_2$ flowing through $LN_2$ tubing 36. Ideally, electronic or manual controls coordinate opening, closing and degree off low of high pressure steam and $LN_2$ through respective valves 16 and 40.

From the valve, the $LN_2$ flows through pipe 42 into nozzle 44. FIG. 1 shows one nozzle, but multiple nozzles can be used. A single nozzle is generally effective.

As $LN_2$ nozzle 44 injects cryogenic fluid into mixing region 32, the $LN_2$ and warm, humid meet. This creates substantial turbulence such that the $LN_2$ and humid air mix. As the $LN_2$ warms, it cools the humid air stream turning the entire gas mixture into fog.

Due to the large volume of entrained air, the fog 48 (FIG. 1) moves under high velocity out the end of conical diffuser 48. The velocity is such that the front wall of fog reaches about 90 feet (27½ m) in about 10 seconds. Depending on the area of fog needed, one can use a single fog generating apparatus such as the one shown in 1, or several can be used. If the amount of fog requires more than one fog generator, they may be spaced along the rear of a stage or they may be mounted together with the conical diffusers 48 aimed apart.

The fog contains a mixture of air, nitrogen gas from the evaporated $LN_2$ (assuming $LN_2$ is the cryogenic fluid), and water vapor. Because of the large amount of air, the fog contains almost normal oxygen content. Therefore, people working in the fog can breath normally, and special effects devices that rely on combustion continue to work properly.

Because of the valving system, the flows of steam and $LN_2$ can stop and start immediately. Therefore, fog generation can start promptly on cue. Likewise, closing the valves also stops fog generation immediately and on cue.

The fog generator works best if the high pressure steam is hot enough to remain gaseous when its exits nozzles 20 and 22. Also, the steam should be under high pressure so that sufficient quantities can be injected at high velocity. That merely requires maintaining the steam generator or boiler at a high enough temperature. If the tubing 12 and 24 is too long or not sufficiently insulated, or if steam remains in the tubing for too long so that it cools, the steam partially condenses. If so, the nozzles will inject less steam, and the steam will contain water droplets. Similarly, the $LN_2$ or other cryogenic liquid should be kept cold through proper storage techniques and prompt use. Using steam that contains partially condensed liquid water and $LN_2$ that contains gaseous nitrogen decrease fog production and may add water droplets to the fog. Water droplets tend to drop out of the fog and wet the stage.

Figure 2:
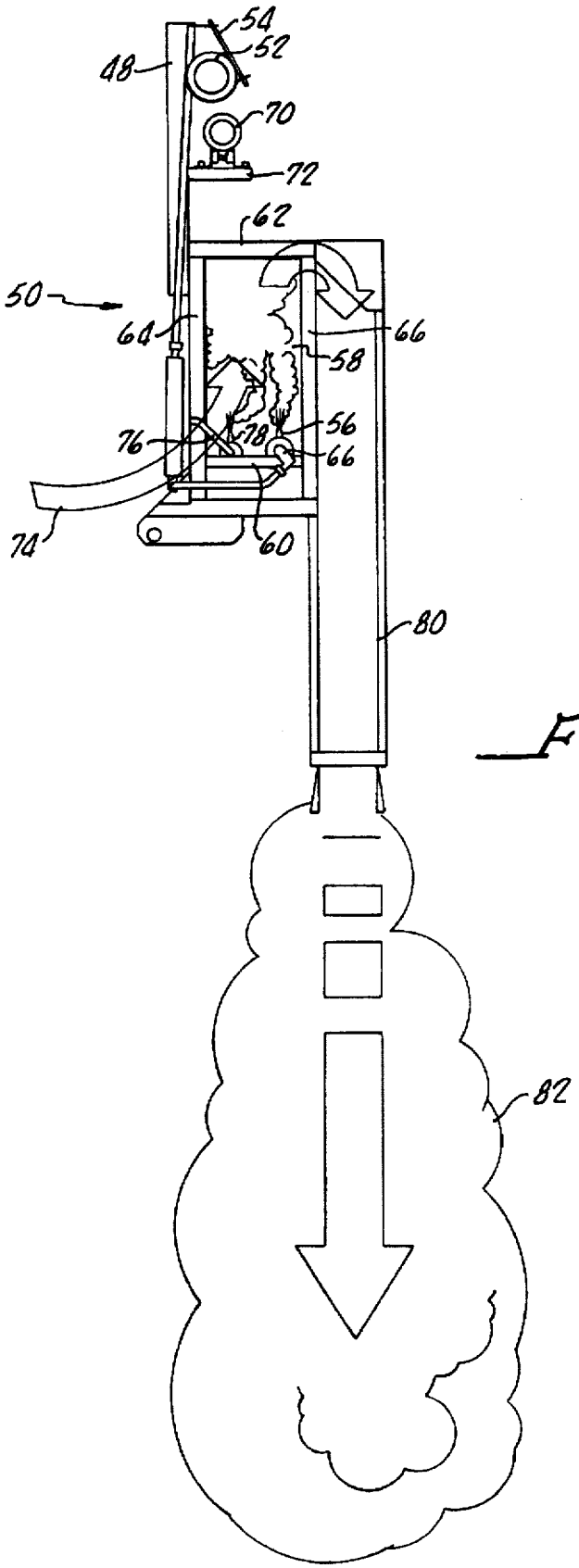
FIG. 2 is a schematic drawing of a second exemplary embodiment of the apparatus for creating fog for special effects of the present invention. This embodiment is designed to create high volume and low velocity fog.

FIG. 2 shows a second exemplary embodiment of the fog generating apparatus of the present invention. Whereas the first embodiment (FIG. 1 ) generates high volume of fog at high velocity, this embodiment generates high volume/lower velocity fog. Having two different fog velocities allows creation of different special effects.

In this embodiment, the fog generating apparatus 50 hangs from a ceiling beam or joist 48. The beam also carries steam tubing 52 and fitting 54 from a boiler (not shown) to the apparatus. Although also not shown, a steam separator, which removes liquid $H_2O$ from the steam line, and a control valve, which selectively blocks or limits steam flowing through steam tubing 52, may act on the steam.

From the steam tubing 50, the steam flows into a nozzle. FIG. 2 shows a single nozzle 56 mounted in a mixing chamber 58. A base 60, a cover 62 and side walls 64 and 66, along with front and rear walls (not shown) form the mixing chamber. Nozzle 56 mounts in a section 66 of the steam pipe that traverses the mixing chamber. The drawing does not show the connection between pipe section 66 and the rest of the steam tubing 52. Though FIG. 2 shows only a single nozzle, the device can use multiple nozzles.

The mixing chamber's side walls 64 and 66 and the base 60 have openings (not shown) in the lower part of mixing chamber 58. These openings allow ambient air to enter near the bottom of the mixing chamber. The openings may have vanes, doors or other structure that can partially block the openings to control the amount of air that enters the mixing chamber.

When nozzle 56 injects steam in the base of the mixing chamber, the cooling and expanding steam entrains large quantities of air (shown as arrow 74), drawing the air into mixing chamber 58. The air and steam mix in the chamber. The air begins cooling the steam, and the cooled steam becomes water vapor, which humidifies the air.

$LN_2$ also flows into mixing chamber 58. Tubing 70 for $LN_2$ mounts on fitting 72, which supports the tubing on beam 48 (FIG. 2). Tubing 70 connects to a tank (not shown). A control valve (also not shown) may block or limit $LN_2$ flowing through $LN_2$ tubing 70.

From the valve, the $LN_2$ flows through pipe 76 into nozzle 78. FIG. 2 shows a single nozzle, but multiple nozzles can be used. As $LN_2$ nozzle 78 injects cryogenic fluid into mixing chamber 58, the $LN_2$, and humid air meet. This creates substantial turbulence such that the $LN_2$ and humid air mix. As the $LN_2$ warms, it cools the humid air steam mixture turning the entire gas mixture into fog. The fog passes through openings (not shown) in the mixing chamber 58 into an exit duct 80. From the exit duct, the fog 82 billows slowly outward.

To increase the volume of fog, one could extend the width of the mixing chamber 58 and exit duct 80 and have multiple nozzles 56 and 78 along tubes 66 and 76. Alternatively, one could have several mixing chambers and exit ducts spaced along a ceiling or other location.

Figure 3:
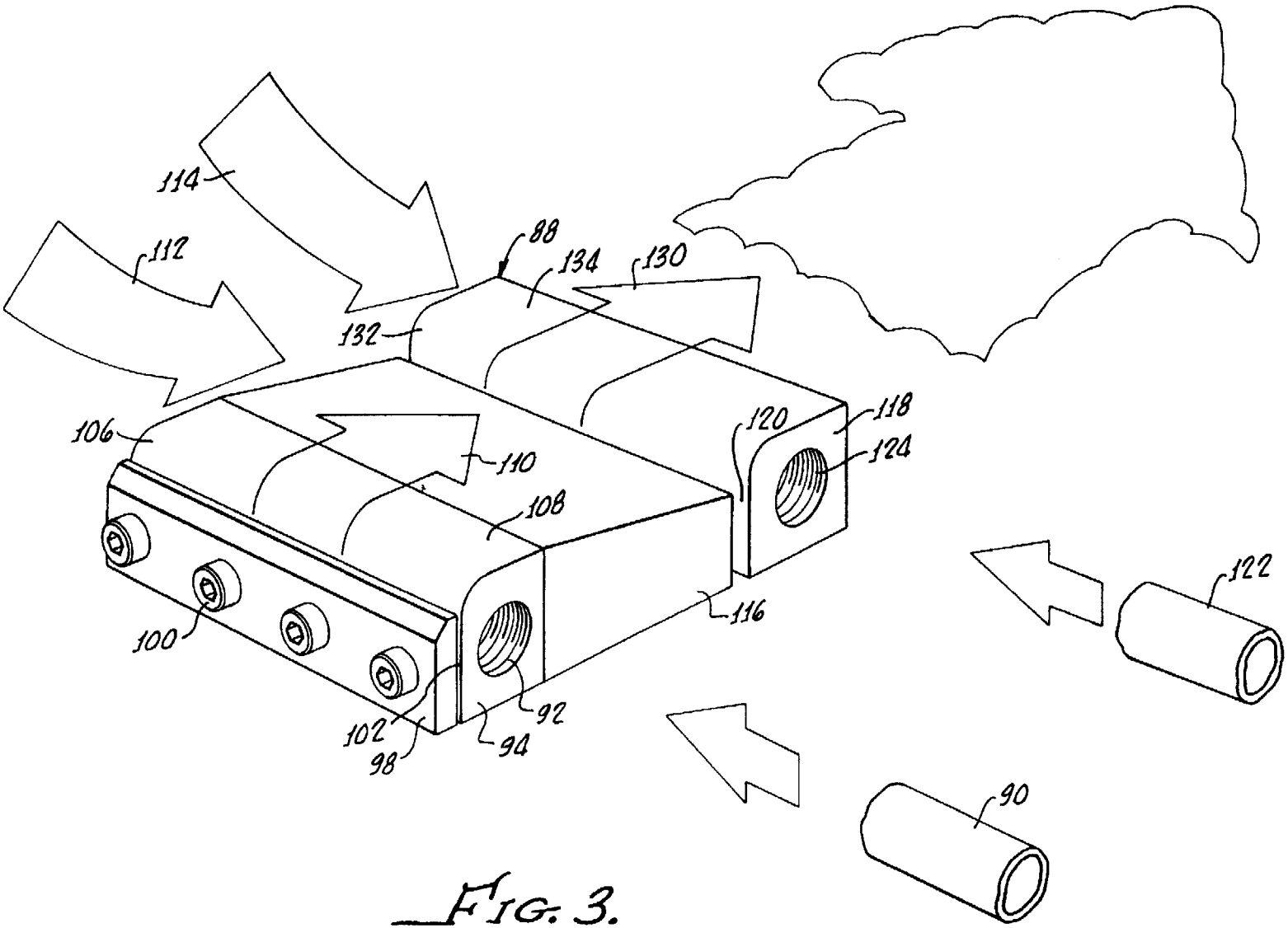
FIG. 3 is a schematic drawing of a third exemplary embodiment of the apparatus for creating fog for special effects of the present invention.

FIG. 3 shows the next embodiment. There, steam from hose 90 enters opening 92 in steam block 94 in fog generator 88. Bolts 100 connect a short plate 98 to the upstream end of block 94. The bolts adjust the width of slot 102 between plate 98 and block 94. One or more passages or a lateral slot (not shown) lead from opening 92 to slot 102. The passages extend along the entire width of the block. Consequently, high pressure steam from steam hose 90 and opening 92 flows as a wide, thin stream between plate 98 and block 94 along generally the entire block's width. The fog generator can be made to any reasonable width.

The steam stream first encounters a rear, upper curved surface 106 and then a flat surface 108 on the block. Because of the coanda effect, the steam flow (see arrow 110) tends to hug flat surface 108 of the block. As the steam cools and expands, it entrains large volumes of atmospheric air (see arrows 112 and 114). That produces a fast moving stream of warm, very humid air.

The humid air stream next passes over a spacer 116. The spacer connects to block 118 in such a way that a slot 120 forms between the spacer and the block.

Cryogenic gas such as $LN_2$ from hose flows into opening 124. One or more passages or a lateral slot (not shown) along the entire width of the block lead from opening 124 into slot 120. Consequently, $LN_2$ from hose 122 flows as a wide, thin stream between spacer 116 and block 118. Again, because of the coanda effect, the $LN_2$ flow (arrow 130) hugs curved surface 132 and then flat surface 134 of the block. There, it encounters the fast moving, humid air stream. The $LN_2$ rapidly cools the humid air, and the turbulence produces a thorough mixing of the $LN_2$ and humid air to produce a fast moving stream of water fog.

Materials chosen for the apparatuses of the exemplary embodiments are not critical except as follows. High pressure steam and cryogenic fluids require materials that can transport and control them. The high humidity can create corrosion, so the materials should be corrosion resistant.

Note also that although the mixing region 32 and conical diffuser 48 in the FIG. 1 embodiment are round, square, rectangular or other shapes are possible. If square, for example, the circumferentially spaced nozzles 20 and 22 could be placed at the corners of the square or along the side walls. Similarly, although chamber 58 (FIG. 2) is rectangular, it could be circular or other shapes.

Numerous modifications and alternate embodiments will occur to those skilled in the art. Therefore, applicant intends that only the appended claims may limit the invention's scope.

We claim:

1. A process for creating special effects fog comprising:

a. injecting steam toward an open end of a chamber;

b. directing the steam such that the steam entrains ambient air and pulls the air into the chamber, and the steam and air mixing to form a humid air stream traveling toward the open end of the chamber;

c. injecting a cryogenic fluid into the humid air stream to mix with and cool the humid air stream.

2. A process for creating special effects fog comprising:

a. directing steam along a first, elongated curved surface, the curved surface being exposed to ambient air, the steam entraining the air and mixing with the air to form moving, humid air;

b. directing cryogenic fluid over a second, elongated curved surface, at least part of the second curved surface being in the path of the moving, humid air, the cryogenic fluid mixing with the humid air to create fog.

3. A process for creating special effects fog comprising:

a. directing steam in a mixing chamber, the mixing chamber being exposed to ambient air, the steam entraining the air and pulling the air into the mixing chamber whereby the steam and entrained air mix;

b. directing cryogenic fluid into the mixing chamber downstream of the location in which steam was directed into the mixing chamber and in the path of the steam and entrained air such that the cryogenic fluid mixes with the steam and entrained air.

4. An apparatus for creating fog comprising:

a. a mixing chamber;

b. a steam nozzle in the mixing chamber injecting steam into the chamber;

c. an air opening into the mixing chamber, the air opening being positioned such that steam from the steam nozzle entrains ambient air from outside the mixing chamber, the steam and air mixing to form humid air; and d. a cryogenic fluid nozzle in the path of the humid air.

5. The fog creating apparatus of claim 4 wherein the steam nozzle comprises a plurality of circumferentially spaced nozzles mounted near the air opening, the cryogenic fluid nozzle being mounted downstream and in the path of steam from the steam nozzles.

6. The fog creating apparatus of claim 4 further comprising means at the air opening of the mixing chamber for selectively blocking the air flow into the mixing chamber.

7. An apparatus for creating fog comprising:

a. a steam inlet; a first curved surface and a first slot adjacent the first curved surface, the first slot communicating with the steam inlet;

b. a cryogenic fluid inlet; a second curved surface spaced from the first curved surface and in the path of steam traveling along the first curved surface, a second slot adjacent the second curved surface, the second slot communicating with the cryogenic fluid inlet.

* * * * *